US010508484B1

(12) United States Patent
Zhao

(10) Patent No.: US 10,508,484 B1
(45) Date of Patent: Dec. 17, 2019

(54) AUTO-LOCK FOLDING PROP ROD

(71) Applicant: GM GLOBAL TECHNOLOGY OPERATIONS LLC, Detroit, MI (US)

(72) Inventor: Stella R. Zhao, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/009,589

(22) Filed: Jun. 15, 2018

(51) Int. Cl.
*E05F 5/02* (2006.01)
*E05F 5/00* (2017.01)

(52) U.S. Cl.
CPC ..... *E05F 5/00* (2013.01); *E05Y 2900/536* (2013.01)

(58) Field of Classification Search
CPC ..... E05F 5/00; E05Y 2900/536; E05Y 2900/548; Y10T 16/54052; Y10T 16/5474; Y10T 16/547
See application file for complete search history.

(56) References Cited

U.S. PATENT DOCUMENTS 858,488 A * 7/1907 Tynes ..... B65D 37/00 220/9.2
1,851,630 A * 3/1932 Johnson ..... E05C 17/34 292/263
1,966,205 A * 7/1934 Johnson ..... E05C 17/32 217/60 E
2,038,143 A * 4/1936 Swanson ..... A47B 5/04 248/240.4
2,483,899 A * 10/1949 Vito ..... A47B 5/04 108/134
3,113,533 A * 12/1963 Snow ..... A47B 5/04 108/134
3,480,247 A * 11/1969 Waner ..... E04G 25/00 16/82
3,563,592 A * 2/1971 Preston ..... E05C 17/32 292/263
3,825,290 A * 7/1974 Messina ..... E05B 65/0888 292/262
4,068,601 A * 1/1978 Marsh ..... A47B 5/04 108/134
4,070,049 A * 1/1978 Brewer ..... E05C 19/004 292/263
4,263,978 A * 4/1981 Jackson ..... E05F 1/1075 16/80
4,393,541 A * 7/1983 Hujsak ..... B25J 17/0241 16/291
4,615,637 A * 10/1986 Pelischek ..... B64G 1/222 16/294

(Continued)

FOREIGN PATENT DOCUMENTS

GB 217919 A * 10/1924 ..... B60J 7/0069

*Primary Examiner* — Chuck Y Mah

(57) ABSTRACT

An auto-lock prop rod for a vehicle includes a folding rod having at least two section rod sections, wherein the folding rod includes a first rod section having a first end pivotally connected to an engine compartment opening and a second rod section having a first end pivotally connected to a hood. At least one pivotable joint is mechanically connected between a second end of the first rod section and a second end of the second rod section, wherein the at least one pivotable joint is configured to axially rotate to a locked position when the hood is moved from a closed position to an fully open position.

11 Claims, 6 Drawing Sheets

(56) References Cited

U.S. PATENT DOCUMENTS

| | | | | | |
|---|---|---|---|---|---|
| 4,819,300 | A * | 4/1989 | Jackson | E05C 17/32 | 16/327 |
| 5,575,513 | A * | 11/1996 | Tuttle | E05C 17/30 | 16/82 |
| 5,715,573 | A * | 2/1998 | Holemans | B64G 1/222 | 16/287 |
| 5,749,425 | A * | 5/1998 | Cudden | B62D 25/10 | 180/68.4 |
| 5,941,011 | A * | 8/1999 | Baker | A01K 77/00 | 16/366 |
| 6,916,058 | B2 * | 7/2005 | Krajenke | B60J 7/205 | 296/100.07 |
| 7,731,165 | B2 * | 6/2010 | Schmidt | E05C 17/30 | 180/69.2 |
| 7,735,810 | B2 * | 6/2010 | Pope | B62D 25/12 | 188/300 |
| 8,311,701 | B2 * | 11/2012 | Iwai | B60R 21/38 | 701/36 |
| 8,752,810 | B2 * | 6/2014 | Anderson | F16F 9/56 | 188/300 |
| 9,414,670 | B2 * | 8/2016 | Bo | A47B 3/002 | |

* cited by examiner

AUTO-LOCK FOLDING PROP ROD

FIELD

This invention relates to props used for supporting a closure panel in an extended position removed from an opening and in particular to closure panels such as lids, or hoods for closing an opening formed in a vehicle body such as a trunk or engine compartment. It will however be understood that the invention will likewise find application for propping other types of closure panels, for example hinged closure panels for storage containers.

BACKGROUND

It is common practice to provide a closure panel such as a hood for closing a vehicle engine compartment, the hood being hinged to the vehicle body for movement between an extended position removed from the engine compartment and a retracted position where the hood closes the engine compartment to protect it from weather, dirt and debris. In the extended position, the hood provides access to the engine compartment for maintenance and inspection of the engine compartment and it is therefore required to provide means for supporting the hood in such an extended position.

Commonly, a prop is pivotally connected at one end to the vehicle body adjacent to the engine compartment and has a free end which is selectively engaged with a portion of the vehicle hood, such as a receiving aperture. One problem which is associated with vehicle hoods is that the operator must have one hand free to raise and support the hood in the extended position until the free end of the prop is engaged in the receiving aperture by another hand.

Another problem which arises is that since there is no feature to lock the prop rod in the hood, unintentional disengagement is possible, and if it becomes disengaged by a sudden movement of the vehicle, vibration or wind, the hood will suddenly be released and close the compartment, and perhaps injure an operator. Also, there is little feedback to the user regarding if the prop rod is fully engaged in the receiving aperture or not, allowing greater possibility of partial engagement due to user operational error, which increases the chance of accidental unintended disengagement. One of the objects of this invention is to provide a prop assembly which will alleviate these problems.

SUMMARY

One or more exemplary embodiments address the above issue by providing an auto-lock folding prop rod. In accordance with an exemplary embodiment, an auto-lock folding prop rod includes a folding rod having at least two section rod sections, wherein the folding rod includes a first rod section having a first end pivotally connected to a location on the body structure near a forward or outboard perimeter of the compartment opening and a second rod section having a first end pivotally connected to a forward or outboard perimeter of a.compartment cover panel. And another aspect in accordance with an exemplary embodiment includes at least one pivotable joint with a joining member pivotally connected to a second end of the first rod section and a second end of the second rod section, wherein the at least one pivotable joint is configured to align the first rod section and second rod section to form a straight line when the compartment cover panel is moved from a closed position to an fully open position.

And a further aspect is presented wherein the at least one pivotable joint further includes an axially rotatable tube configured to rotate axially to lock the joint and the two rod sections in the straight aligned position when the compartment cover panel is in the fully open position. And still another aspect wherein the at least one axially rotatable joint further includes a joining member pivotally connected between the second ends of the first and second rod sections. And yet another aspect wherein the at least one pivotable joint further includes a torsion spring configured to axially rotate the rotatable tube to the locked position automatically with no additional user action required when the compartment cover panel is moved to the fully open position.

And another aspect in accordance with the exemplary embodiment wherein at least one of the first and second rod section further includes an anti-over rotation pin that cooperates with the rotatable tube to limit axial rotation of the rotatable tube. And still another aspect wherein the rotating tube is configured to rotate axially 90 degrees to the locked position. And yet another aspect wherein the at least one axially rotatable tube is configured to be manually moved to an unlock position by reverse rotation of the rotatable tube 90 degrees from the locked position. And other aspects are provided wherein the compartment opening is an engine compartment opening, and wherein the compartment cover panel is a hood.

BRIEF DESCRIPTION OF THE DRAWINGS

The present exemplary embodiment will be better understood from the description as set forth hereinafter, with reference to the accompanying drawings, in which.

DETAILED DESCRIPTION OF THE INVENTION

The following description is merely exemplary in nature and is not intended to limit the present disclosure, application, or uses thereof.

Figure 1:
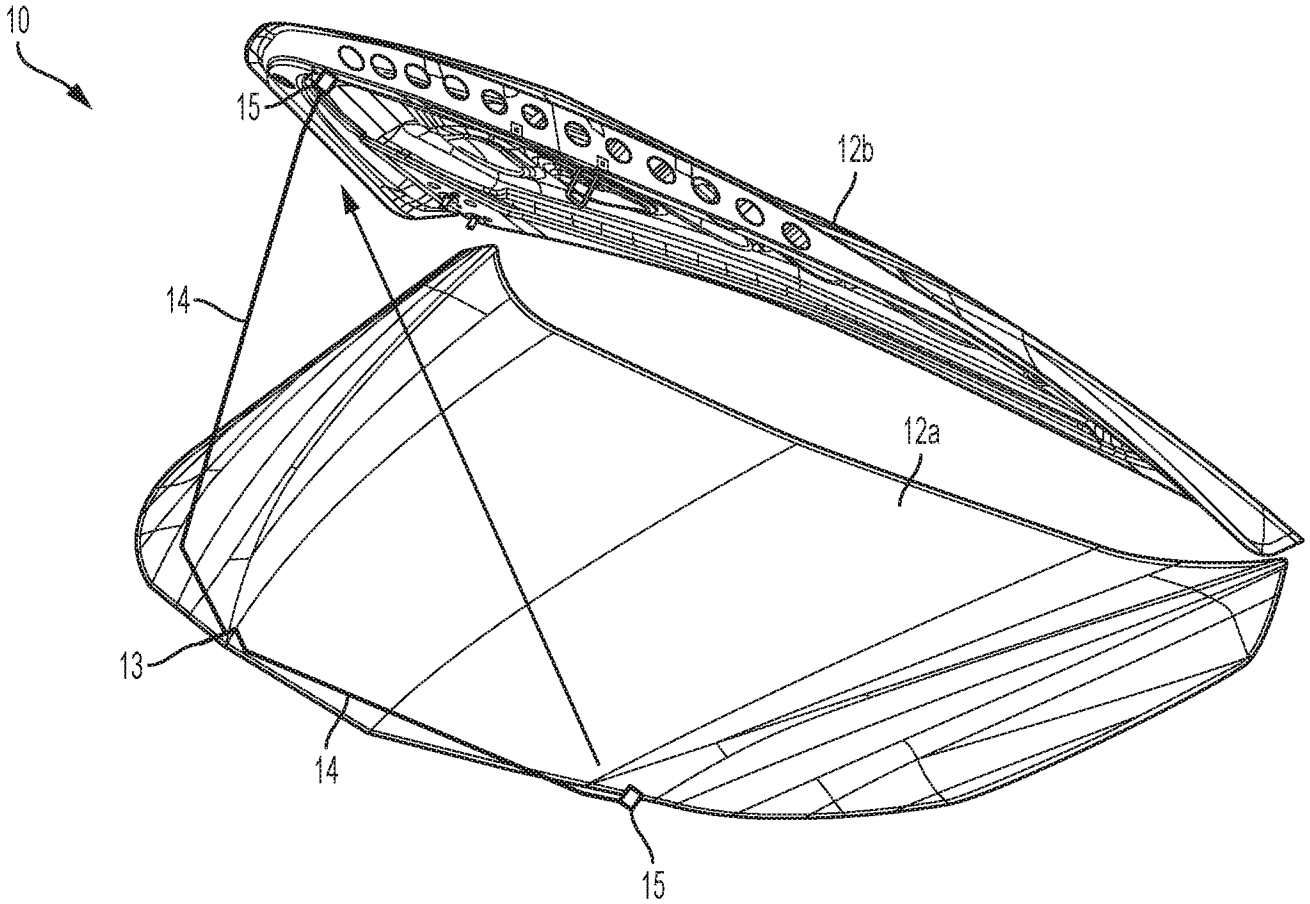
FIG. 1 PRIOR ART
FIG. 1 is an illustration of a vehicle hood prop rod that is well known in the prior art.

FIG. 1 provides an illustration 10 of a vehicle hood prop rod that is well known in the prior art. When the vehicle hood is in the closed position 12*a* the prop rod 14 is pivotally attached at one end 13 to a location on the body structure near the perimeter of the hood opening. The prop rod 14 includes a free end 15 which is selectively engaged to the vehicle hood when the hood is lifted by the operator to the open position 12*b*. In this case, the operator must have one hand free to raise and support the hood in the extended position 12*b* until the free end 15 of the prop rod 14 is engaged in a receiving aperture by another hand. A greater concern is that since there is no feature to lock the prop rod in the hood, unintentional disengagement is possible, and if it becomes disengaged by a sudden movement of the vehicle, vibration or wind, the hood will suddenly be released and close the compartment, and perhaps injure an operator.

Figure 2:
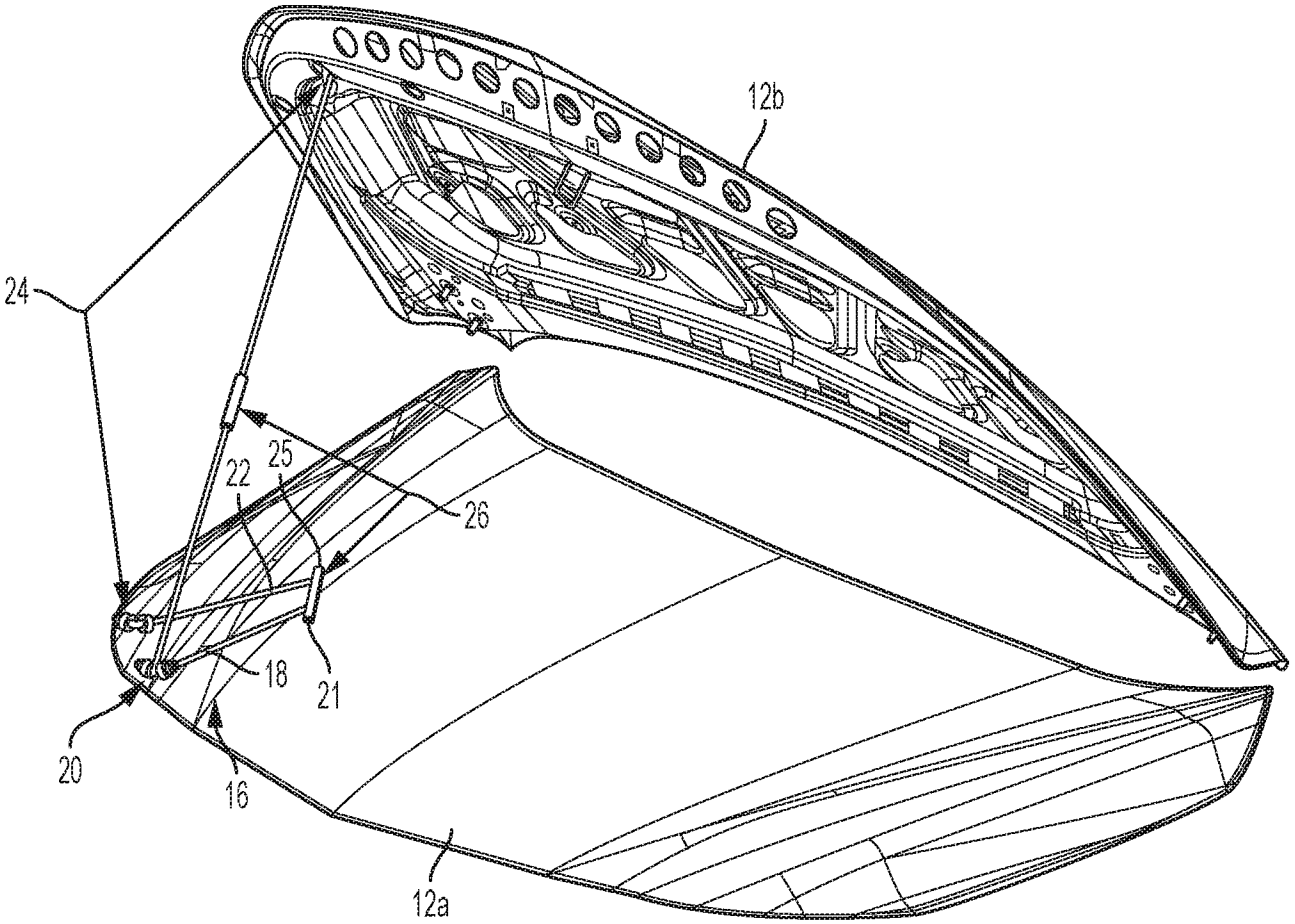
FIG. 2 is an illustration of an auto-lock folding prop rod in accordance with aspects of an exemplary embodiment.

FIG. 2 is an illustration of an auto-lock folding prop rod 16 in accordance with aspects of an exemplary embodiment which is provided for overcoming the above shortcomings of the prior art. The folding prop rod 16 includes at least two section rod sections, wherein the folding rod 16 includes a first rod section 18 having a first end 20 pivotally connected to a location on the body structure near the forward or outboard perimeter of the compartment opening such as the frontal tie bar, and a second rod section 22 having a first end 24 pivotally connected to compartment cover panel 12. It should be understood that the compartment cover panel 12 is represented as 12*a* when in the closed position and represented as 12*b* when in the opened position. The auto locking prop rod 16 also includes at least one pivotable joint 26 with a joining member pivotally connected to a second end 21 of the first rod section 18 and a second end 25 of the second rod section 22, wherein the at least one pivotable joint is configured to align the first rod section and second rod section to form a straight line when the compartment cover panel 12 is moved from a closed position 12*a* to an fully open position 12*b*.

Figure 3C:
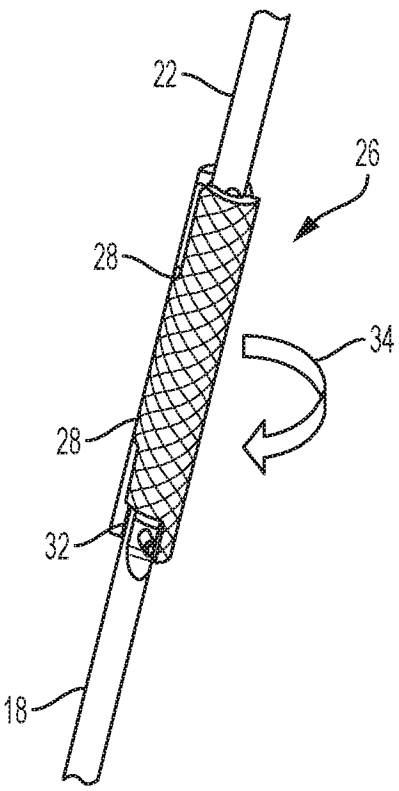
FIG. 3C is an illustration of the pivotable joint of the prop rod when it is in the extended and unlocked position in accordance with aspects of the exemplary embodiment.
Figure 3B:
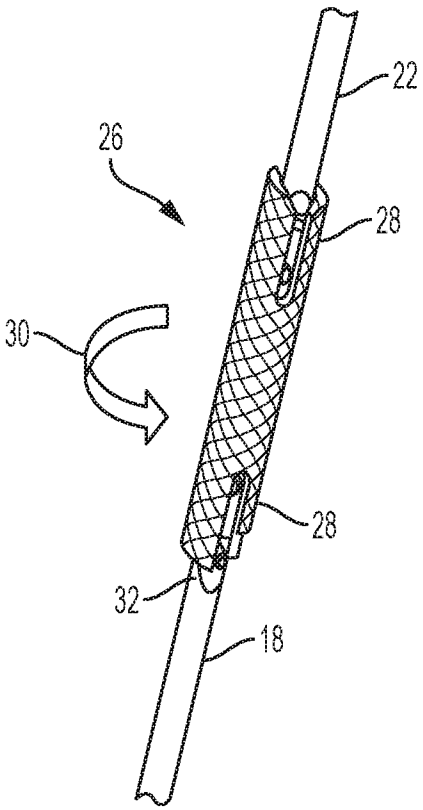
FIG. 3B is an illustration of the pivotable joint when the prop rod is in an extended and locked position in accordance with aspects of the exemplary embodiment.
Figure 3A:
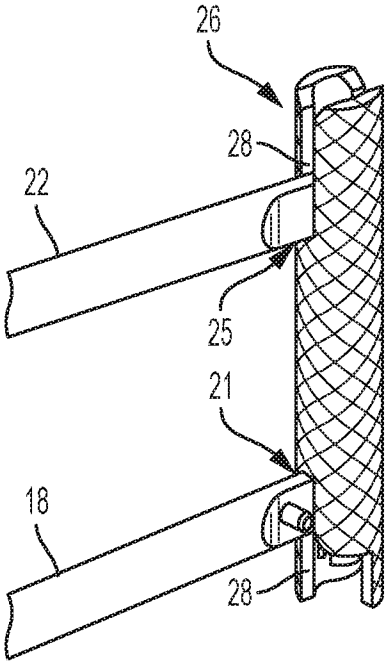
FIG. 3A is an illustration of a pivotable joint when the prop rod is in a folded position in accordance with the exemplary embodiment.

FIG. 3A is an illustration of a pivotable joint 26 when the prop rod 16 is in a folded position in accordance with the exemplary embodiment. An axially rotatable tube 36 covering the pivotable joint 26 includes folding channels 28 that cooperate with the second ends (21, 25) of the first and second rod sections (18, 22) when the prop rod 16 is in a folded position. The tapered ends (21, 25) of the first and second rod sections (18, 22) are configured to be pivotally moved into the folding channels 28 when the prop rod 16 is urged into the folded position, and conversely move pivotally out of the folding channels 28 when the prop rod 16 is at an extended position as illustrated in FIG. 3C.

Still referencing FIG. 3B, upon transition of the prop rod 16 from the folded position to an extended position, the axially rotatable tube 36 automatically rotates 90 degrees in a counterclockwise direction 30 such that the tapered ends (21, 25) of the first and second rod sections (18, 22) are offset from the folding channels 28 causing the prop rod 16 to be locked in the extended position. To prevent over rotation of the axially rotatable tube 36, at least one of the first and second rod sections (18, 22) includes an anti-over rotation pin 32 that operates to limit axial rotation of the axially rotatable tube 36 beyond the 90 degree position. When the operator desires to unlock the prop rod 16 for closing the compartment cover panel, as best illustrated in FIG. 3C, the axially rotatable tube 36 is manually rotated 90 degrees clockwise such that the tapered ends (21, 25) of the first and second rod sections (18, 22) are aligned with the folding channels 28.

Figure 4:
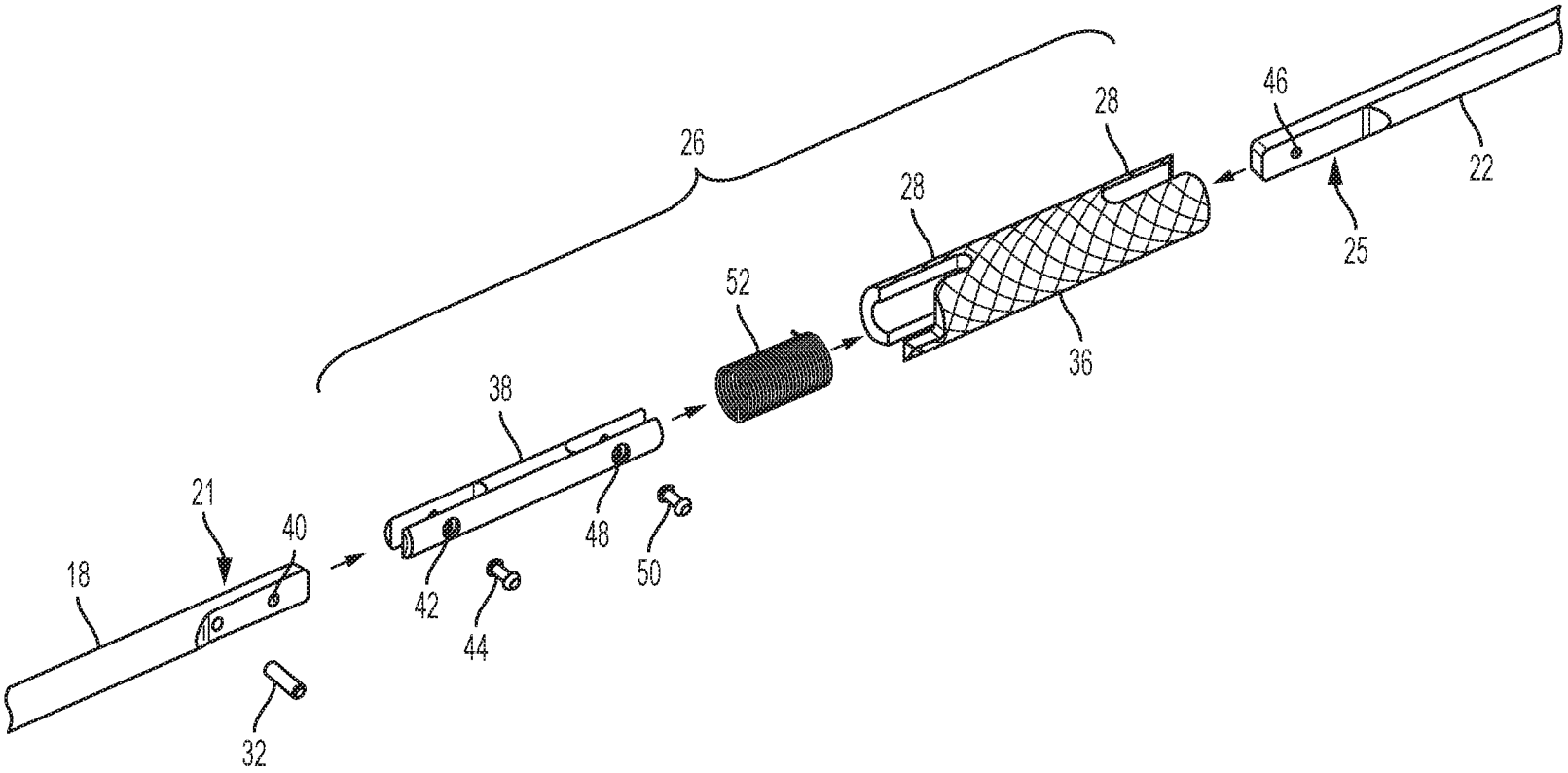
FIG. 4 is an illustration of an exploded of the pivotable joint of the prop rod in accordance with aspects of the exemplary embodiment.

Referring now to FIG. 4, an illustration of an exploded of the pivotable joint 26 of the prop rod 16 in accordance with aspects of the exemplary embodiment is provided. The pivotable joint 26 includes the axially rotatable tube 36 configured to automatically lock the folding prop rod in the extended position when the compartment cover panel 12 is in the fully open position. As described above, the axially rotatable tube 36 includes folding channels 28 for cooperating with the tapered ends (21, 25) of the first and second rod section (18, 22) when the prop rod 16 is manipulated between folded to extended positions. The pivotable joint 26 also includes a joining member 38 that pivotally connects between the second ends (21, 25) of the first and second rod sections (18, 22). The second end 21 of the first rod section 18 includes an aperture 40 that aligns with an aperture 42 of the joining member 38 before a swivel pin 44 is inserted to fasten the components together and allow pivotal movement about the axis. Likewise, the second end 25 of the second rod section 22 includes an aperture 46 that aligns with an aperture 48 of the joining member 38 before a swivel pin 50 is inserted to fasten the components together and allow pivotal movement about the axis. To facilitate the automatic rotation of the rotatable tube 36 a torsion spring 52 is disposed between the joining member 38 and the rotatable tube 36. When the prop rod 16 is in a folded position, the torsion spring 52 exerts a twisting force on the axially rotatable tube 36 that is restrained from release by the tapered ends (21, 25) that are sitting in the folding channels 28 until the prop rod 16 is moved to the extended position. Upon movement to the extended position, the first rod section 18, the second rod section 22, and the joining member 38 aligns into a straight line. The tapered ends (21, 25) move completely out of the folding channels 28, and the axially rotatable tube 36 is allowed to freely rotate with no restrains. The torsional force from the torsion spring 52 causes the unrestrained rotatable tube 36 to move counterclockwise 90 degrees to lock the prop rod 16 in the extended position while the anti-over rotation pin 32 restricts rotation beyond the desired locking position.

Figure 5B:
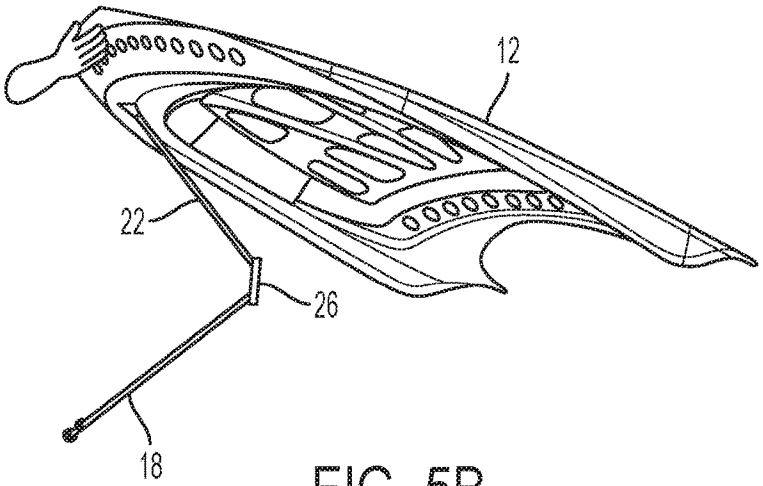
FIG. 5B is an illustration of the auto locking prop rod being extended automatically when the operator is manually opening the hood in accordance with aspects of the exemplary embodiment.
Figure 5C:
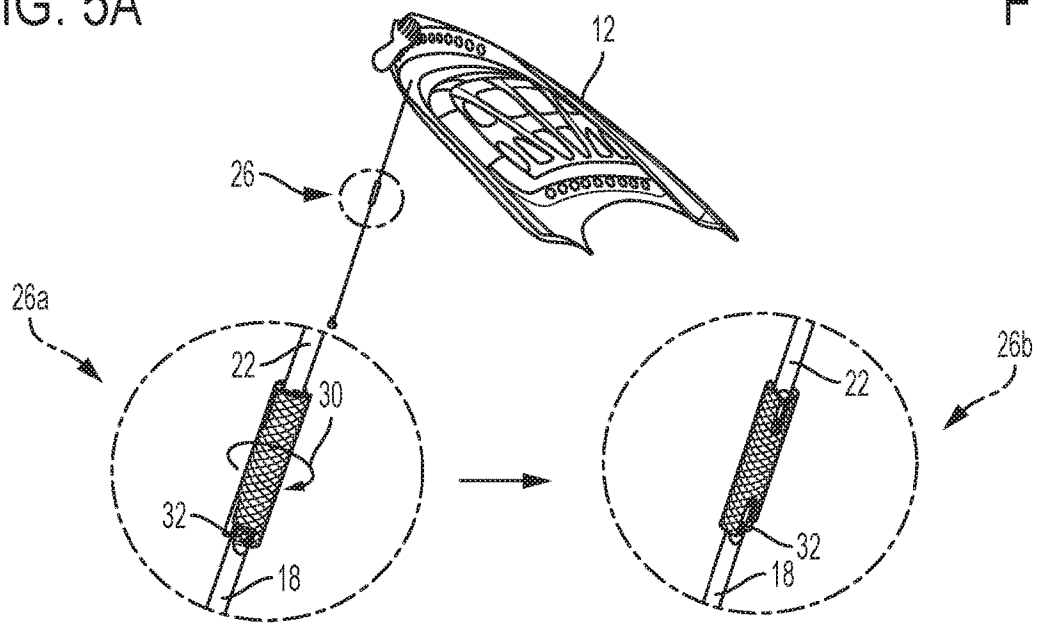
FIG. 5*c* is an illustration of the prop rod in the extend position and axially rotatable tube transition to the locked position in accordance with the exemplary embodiment.
Figure 5A:
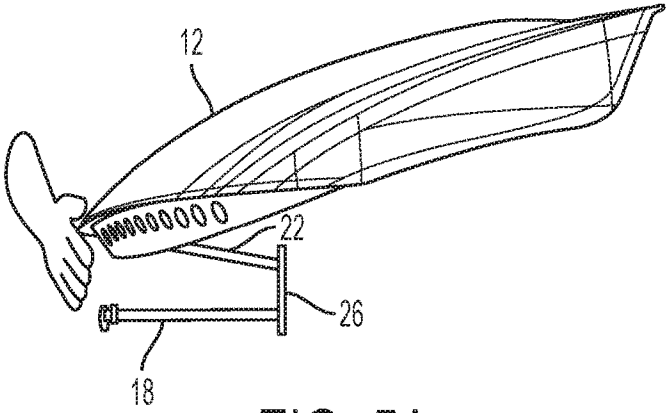
FIG. 5A is an illustration of the auto locking prop rod in the folded position prior to extension in accordance with aspects of the exemplary embodiment.

FIGS. 5A-5C illustrate the auto lock folding prop rod 16 being deployed from a folded position to and extended and locked position. FIG. 5A illustrates an operator using a hand to lift the compartment cover panel 12 which preferably is a vehicle hood 12 that covers an engine compartment opening. As according to the exemplary embodiment. FIG. 5B further illustrates the operator continuing to use one hand to lift the vehicle hood 12 as there is no need to raise and support the hood with one hand in the extended position until the free end of the prop is engaged in the receiving aperture by another hand as according to prop rods of the prior art. FIG. 5C illustrates the vehicle hood 12 and prop rod 16 fully extended before the axially rotatable tube 36 is automatically rotated counterclockwise to turn the pivotable joint 26 from the unlocked position 26*a* to the locked position 26*b*. Since the locking mechanism engages automatically by torsional spring force once the hood is fully extended, it eliminates the possibility of falling risks due to prop rod partial engagement from user error which exists in prior art.

Figure 6B:
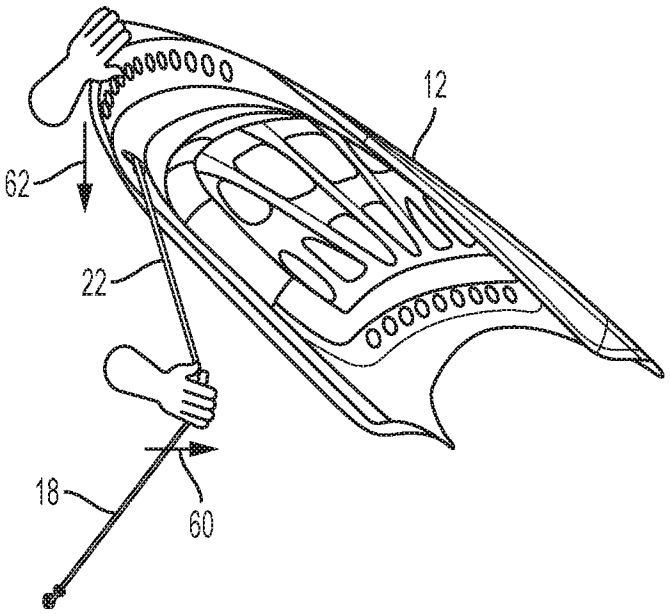
FIG. 6B is an illustration of the extended prop rod being folded after being unlocked by an operator in accordance with aspects of the exemplary embodiment.
Figure 6A:
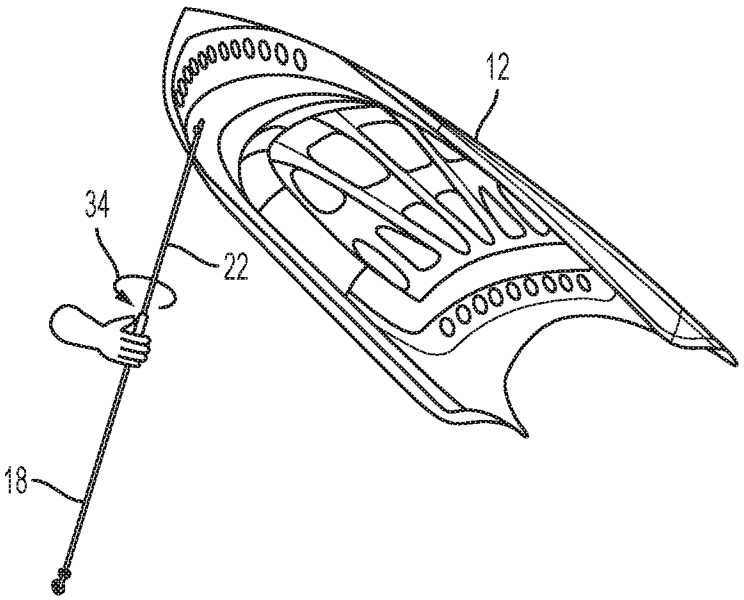
FIG. 6A is an illustration of the extended prop rod being unlocked for moving to the folded position in accordance with the exemplary embodiment.

FIGS. 6A and 6B illustrate the auto lock folding prop rod 16 being moved from an extended and locked position to a folded and closed position such that the vehicle hood 12 can be closed. FIG. 6A illustrates the operator manually rotating the axially rotatable tube 36 with one hand by 90 degrees in a clockwise direction to unlock the prop rod 16. However, although unlocked, the prop rod 16 remains in the extended position until as illustrated in FIG. 6B, the operator holds the vehicle hood 12 with a second hand to start lowering it, moves the tapered ends (21, 25) of the first and second rod sections (18, 22) of the extended prop rod 16 into the folding channels 28 while holding and pressing on the pivotable joint 26 toward the direction 60 to cause the prop rod 16 to fold. Thereafter, the operator can fully close the vehicle hood 12 using one hand by lowering it in the direction 62. Since the intentional operator action of rotating the tube 36 ninety degrees is needed to unlock prop rod 16 before the hood 12 can be lowered, the chance of accidental hood falls due to unintended prop rod disengagement by a sudden movement of the vehicle, vibration or wind is greatly reduced.

The description of the invention is merely exemplary in nature and variations that do not depart from the gist of the invention are intended to be within the scope of the invention. Such variations are not to be regarded as a departure from the spirit and scope of the invention.

What is claimed is:

1. An auto-lock folding prop rod comprising:

a folding rod having a first rod section having a first end pivotally connected to a location on a body structure near a forward or outboard perimeter of a compartment opening and a second rod section having a first end pivotally connected to a forward or outboard perimeter of a compartment cover panel;

at least one pivotable joint with a joining member pivotally connected to a second end of the first rod section and a second end of the second rod section, wherein the at least one pivotable joint is configured to align the first rod section and the second rod section to form a straight line when the compartment cover panel is moved from a closed position to an fully open position; and further comprising an axially rotatable tube covering the joining member, the second end of the first rod section, and the second end of the second rod section and configured to rotate axially to lock the at least one pivotable joint and the first and second rod sections in a straight aligned position when the compartment cover panel is in the fully open position by preventing the first rod section and the second rod section from pivoting.

2. The prop rod of claim 1 wherein the at least one pivotable joint further comprises a torsion spring disposed around the joining member and connected at one end to the axially rotatable tube and connected at another end to the joining member and configured to axially rotate the rotatable tube to the locked position automatically when the compartment cover panel is moved to the fully open position.

3. The prop rod of claim 1 wherein the axially rotatable tube is configured to rotate axially 90 degrees to the locked position.

4. The prop rod of claim 1 wherein the at least one axially rotatable tube is configured to be manually moved to an unlock position by reverse rotation of the axially rotatable tube 90 degrees from the locked position.

5. The prop rod of claim 1 wherein the compartment opening is an engine compartment opening.

6. The prop rod of claim 1 wherein the compartment cover panel is a hood.

7. An auto-lock folding prop rod for a vehicle comprising:

a folding rod having a first rod section having a first end pivotally connected to a location on the body structure near a forward or outboard perimeter of an engine compartment opening and a second rod section having a first end pivotally connected to a forward or outboard perimeter of a hood;

at least one pivotable joint with a joining member pivotally connected to a second end of the first rod section and a second end of the second rod section, wherein the at least one pivotable joint is configured to align the first rod section and the second rod section to form a straight line when the hood is moved from a closed position to an fully open position; and further comprising an axially rotatable tube covering the joining member, the second end of the first rod section, and the second end of the second rod section and configured to rotate axially to lock the at least one pivotable joint and the first and second rod sections in a straight aligned position when the compartment cover panel is in the fully open position by preventing the first rod section and the second rod section from pivoting, and wherein at least one of the first and second rod section further comprises an anti-over rotation pin that cooperates with a cutout in the axially rotatable tube to limit axial rotation of the axially rotatable tube.

8. The prop rod of claim 7 wherein the at least one pivotable joint further comprises a torsion spring disposed around the joining member and connected at one end to the axially rotatable tube and connected at another end to the joining member and configured to axially rotate the rotatable tube to the locked position automatically when the compartment cover panel is moved to the fully open position.

9. The prop rod of claim 7 wherein the axially rotatable tube is configured to rotate axially 90 degrees to the locked position.

10. The prop rod of claim 7 wherein the at least one axially rotatable tube is configured to be manually moved to an unlock position by reverse rotation of the axially rotatable tube 90 degrees from the locked position.

11. An auto-lock folding prop rod for a vehicle comprising:

a folding rod having a first rod section having a first end pivotally connected to a location on the body structure near a forward or outboard perimeter of an engine compartment opening and a second rod section having a first end pivotally connected to a forward or outboard perimeter of a hood;

at least one pivotable joint with a joining member pivotally connected to a second end of the first rod section and a second end of the second rod section, wherein the at least one pivotable joint is configured to align the first rod section and the second rod section to form a straight line when the hood is moved from a closed position to an fully open position;

further comprising an axially rotatable tube covering the joining member, the second end of the first rod section, and the second end of the second rod section and configured to rotate axially to lock the at least one pivotable joint and the first and second rod sections in a straight aligned position when the compartment cover panel is in the fully open position by preventing the first rod section and the second rod section from pivoting, and wherein the second end of the first rod section has a tapered end and the second end of the second rod section has a tapered end, and the tapered ends move into folding channels disposed in the axially rotatable tube when moved to the closed position.

* * * * *